United States Patent [19]

Steeman

[11] 4,220,203

[45] Sep. 2, 1980

[54] METHOD FOR RECOVERING COAL IN SITU

[75] Inventor: Johannes W. M. Steeman, Geleen, Netherlands

[73] Assignee: Stamicarbon, B.V., Geleen, Netherlands

[21] Appl. No.: 967,089

[22] Filed: Dec. 6, 1978

[30] Foreign Application Priority Data

Dec. 6, 1977 [NL] Netherlands ..... 7713455

[51] Int. Cl.[2] ..... E21C 43/00

[52] U.S. Cl. ..... 166/271; 166/259; 166/50; 166/52; 299/4; 299/5

[58] Field of Search ..... 166/259, 268, 256, 271, 166/50, 52; 299/2, 13, 4, 5; 175/12, 62

[56] References Cited

U.S. PATENT DOCUMENTS

| | | | |
|---|---|---|---|
| 2,788,956 | 4/1957 | Pevere et al. | 166/259 |
| 3,010,707 | 11/1961 | Craighead et al. | 166/259 |
| 3,563,606 | 2/1971 | Sears | 166/259 X |
| 3,775,073 | 11/1973 | Rhoades | 166/256 X |
| 3,933,447 | 1/1976 | Pasini et al. | 166/259 X |
| 3,997,005 | 12/1976 | Komar | 166/256 X |
| 3,999,607 | 12/1976 | Pennington et al. | 166/259 |
| 4,024,914 | 5/1977 | Kreinin | 166/256 X |
| 4,026,356 | 5/1977 | Shuck | 166/259 |
| 4,062,404 | 12/1977 | Pasini et al. | 166/259 |
| 4,095,650 | 6/1978 | Shuck | 166/256 |

*Primary Examiner*—Stephen J. Novosad

*Attorney, Agent, or Firm*—Cushman, Darby & Cushman

[57] ABSTRACT

For the purpose of in-situ recovery of coal a borehole is driven from the surface in the plane of the coal over at least a large part of its travel, as far as conditions permit. At or near its end this borehole is widened over such a length and to such a width as corresponds with at least twice the deviation to be expected in the horizontal projection of a second borehole which is driven so far as to connect the widened section described above. The widened section is preferably made with the aid of mechanical means.

After the boreholes have been linked, the coal is recovered by gasification, dissolution or extraction, whether or not under supercritical conditions and whether or not with attendant chemical/physical disintegration. The method according to the invention is particularly suited for use in the 'in-line' gasification technique.

5 Claims, 1 Drawing Figure

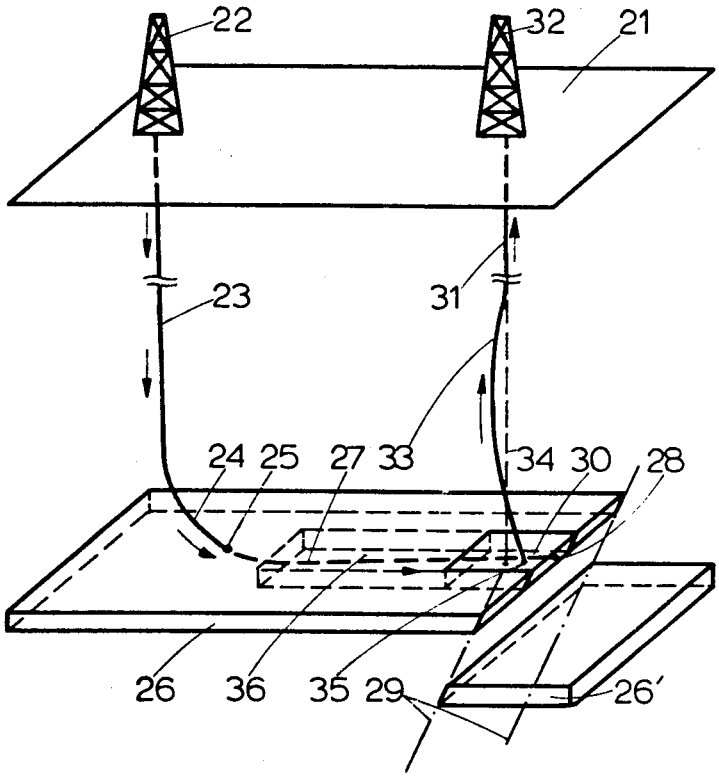
22
32
21
23
31
24
25
27
33
34
30
28
26
36
35
29
26'

METHOD FOR RECOVERING COAL IN SITU

The invention relates to a method for recovering coal in situ by drilling two boreholes from the surface into the coal seam, at least one of which boreholes is at least partially located in the plane of the coal seam, linking the two boreholes near their ends, supplying a medium that will chemically and/or physically react with the coal by way of one of the boreholes and withdrawing the reaction product along the other borehole.

The term 'coal' as used in this context is meant to cover any stratified formation consisting in whole or in part of carboniferous materials, as for example lignite, brown coal or coal. By reacting coal with a medium is meant in the first place the partial combustion of coal with formation of combustible gases, which are taken off ('gasification' of coal), but also the dissolution or extraction coal with a medium, in some instances under supercritical conditions, whether or not with attendant disintegration. Because the state of technology of coal gasification provides the most starting points for tackling the more general problem of recovering coal in situ, the 'gasification' of coal will here be dealt with. The recovery of coal by dissolution, or extraction, whether or not with attendant disintegration, as meant above is also considered to come within the scope of this invention.

The subsoil of western Europe contains immense coal deposits, but these are buried so deeply that recovering them by means of the current techniques such as conventional underground mining is a sheer impossibility. It is an obvious step therefore to search for other techniques enabling at least a portion of this energy reserve to be recovered. Underground gasification, dissolution or extraction of coal come within the range of possibilities, but these techniques involve a high cost figure as the major problem. At the present state of the technology both the length and the width of a recovery area are limited, meaning that the quantity of coal to be recovered along one borehole is also limited. Since the drilling operations consitute an important cost factor, the costprice per ton of coal recovered, or per ton of coal derivative, is still high.

The first limiting factor—the length of the recovery area—is determined by the possibilities of linking the boreholes. When use is made of the current techniques as, for example, 'electrolinking' or 'hydraulic fracturing', this length varies from 20 to 50 m. By 'electro-linking' is meant the linking of two boreholes via shrinkage cracks formed in the coal when this is converted into coke by an electric current. By 'hydraulic fracturing' is meant the linking of two boreholes via the crack system formed by exerting a high pressure on the coal seam by means of a medium (water or air) in the lower end(s) of one borehole, or both.

The second limiting factor—the width—is determined by the flow pattern of the circulating reaction medium. It has appeared that this flow must remain turbulent. When the cavity formed becomes too wide, the quality of the gas will deteriorate, or the combustion may even terminate, owing to insufficient turbulence of the medium. Similar drawbacks attach the use of liquid reaction media.

The methods of partial coal gasification using boreholes for supplying a reaction medium and withdrawing a reaction product can be distinguished into two groups:
(a) the 'longwall' method, (b) the 'inline-burn' method.

The difference between the two is that in the 'longwall' method the combustion front travels perpendicularly to the direction of the gas flow, while in the 'inline-burn' method the front advances in the same direction as the gas, or opposite to it.

In the 'longwall' method a long reaction front is formed. At the end of this front the reaction product is taken off. As the coal is being burnt away, the voided cavity increases in width and problems arise through insufficient mixing of the gases, with the result that the gas produced may contain so much oxygen as to cause it to ignite in the take-off line. In a dipped seam this problem can be partly obviated by stowing the voided cavity. This meets with difficulties, on the one hand because the technology of introducing stowing material is not sufficiently developed and the quantity of stowing material needed is hard to determine, and on the other hand because one is less free in choosing the borehole pattern in the dipped seam.

These two objections are not encountered in the 'inline'-burn method. In this method two boreholes are linked, for example by hydraulic fracturing. When a connecting crack or channel has come into existence, the coal near the one borehole is ignited, while a reaction medium (say, air) is introduced along the other. Combustible gas is then taken off along the first borehole. One preferably works in such a way that the gasification front will advance contrary to the direction of the air flow ('reversed-flow gasification'). In this case the gasification zone is limited to the immediate surroundings of the connecting channel. Experiments with the latter technique in Hanna (USA) have shown that the coal is burnt over a width of no more than 20–30 m, depending on the thickness of the coal seam. This is to be ascribed to the fact that the turbulence of the flowing medium decreases as the void cavity widens.

In summary, the principal limiting factors of the 'inline-burn' method are:
(a) the distance over which two boreholes in the coal seam can be linked,
(b) the void volume in which a sufficiently high Reynolds number can be maintained.

In the 'inline-burn' method the distance between two boreholes is, theoretically, a free parameter. However, practice has proved that two boreholes spaced more than 50 m apart are difficult to link with the current techniques, as e.g. 'electro-linking', 'hydraulic fracturing', the use of explosives forming a passage by burning etc.

In the 'inline-burn' method approximately 1000 m deep boreholes should for economic reasons be spaced at least 200 m apart. Connecting these boreholes consitutes the basic problem of gasifying coal in situ. For these reasons the distance between the boreholes must be much longer than the 50 m that can be bridged by the techniques now available.

The present invention in general envisages to improve the economy of recovering coal in situ, especially if the coal seams are located at a great depth. More in particular the invention envisages to provide the possibility of spacing the boreholes for gasification much further apart, and establishing much longer linkages between them than has been practically feasible so far. Another objective of the invention is to enhance the possibilities for application of, especially, the 'inline-burn' method.

According to the invention this is achieved by widening one of the boreholes near its end in the coal seam to be recovered, and connecting the other borehole with this widened section, and subsequently to start the reaction and keep this going.

According to the known state of technology this is possible if a first borehole is driven through the subsidiary rock into the coal seam to be recovered, and this borehole is widened in this coal seam by mechanical means, or by a chemical reaction, or by dissolution or extraction, whereupon the second borehole is driven over at least part of its travel in the plane of the coal seam until a connection with the widened section is established. Notwithstanding the directional drilling deviations, which are very likely to occur, the presence of this widened section substantially increases the probability that the connection will be established. For widening the end of the first borehole by mechanical means, or by a chemical reaction, dissolution, extraction or disintegration, use may be made of currently known technologies.

According the mode of realizing the invention, the connection is established in this way that the borehole following the plane of the coal seam over at least part of its travel is drilled so far as the geological conditions, the conditions on the surface or the technological conditions permit, at least the final part of this borehole is widened over such a length and to such a width as corresponds with at least twice the maximum deviation to be expected in the horizontal projection of the second hole, which is driven at least so far as to connect with the widened section.

The technique according to the invention has the great advantage that the second borehole need not be started until certainty has been obtained as to the distance one has succeeded in continuing the first borehole following the plane of the coal seam to be recovered. This distance may be limited for example by a previously unknown fault or by other disturbances in the coal seam, or by mechanical conditions.

The widened section at the end of the first-mentioned borehole is preferably formed with the aid of mechanical means. An installation suited for this purpose is described in U.S. Pat. No. 3,961,824 and consists of a scraper comprising elements which are introduced into the borehole in the stretched position and are subsequently arranged in zig-zag fashion. The positioned elements are reciprocated, causing the scrapers (or other elements for loosening the coal) on the pivots of the elements to scrape away the wall of the borehole, thereby dislodging the coal. The dislodged coal is flushed out along the same borehole. The length and width of the chamber formed in the coal depend on the maximum expected deviation of the second borehole.

Although for widening the end of the borehole mechanical means deserve preference, the use of combustion, dissolution, extraction and/or disintegration for this purpose is not to be excluded.

It has already been argued that in the method according to the invention the site and/or direction of the second borehole is/are determined by attendant circumstances, such as geological factors. In most cases this hole will be driven more or less vertically and intersect the subsidiary rock strata to end in the widened section of the first borehole. However, in some instances this borehole may also be driven in the plane of the coal seam over part of its travel. In one conceivable situation each borehole is driven so far in the plane of the coal seam as is technically feasible, so as to obtain a channel of the greatest possible length. Also in this case a widened section has to be formed near the end of one of the boreholes in order to increase the probability that the connection will be made.

Under certain circumstances, which are determined by the hardness of the coal and/or the subsidiary rock, or by the forces acting on one borehole, or both, it may be necessary for one borehole, or both, to be widened over a great part of its/their travel in the coal. This may sometimes be required if a connection is to be made between two boreholes crossing each other in the coal seam, and certainly if the two boreholes are driven contrary to each other along substantially the same line.

The method of the invention consequently ensures that a good connection between the two boreholes will be established already before the start of the reaction (ignition). After the ignition a sufficiently high gas load and thus a turbulent flow in the voided cavity formed can be immediately obtained, unlike in the techniques where the reaction medium is continuously or initially introduced along a crack system. It will be clear that especially the technique of 'in-line' burning can be carried out with good results.

The invention will be elucidated with reference to a drawing. The FIGURE shows a schematic picture of how a connection is established between two boreholes the first of which is driven in the plane of the coal seam to be recovered and is widened near its end, whereupon a borehole is driven through the subsidiary rock towards a widening near the end of the first borehole.

According to the figure a hole 23, drilled from the surface 21 by a drilling installation 22, enters coal seam 26—here depicted as extending horizontally—with a preset deviation 24 at 25. The borehole follows the coal seam 26 along path 27 up to point 28, where further drilling does not serve any purpose owing to the presence of fault 29. The dislocated part of the coal seam is marked 26'.

Next, using the installation described above, chamber 30 is cut out at the end of the borehole in the coal seam. Only after this has been done a second hole 31 is drilled by means of drilling installation 32. Part 33 of borehole 31 shows a distinct deviation from the vertical 34 and strikes chamber 30 in point 35 near the edge of the chamber. In this way a good, continuous linkage has been established, notwithstanding the deviation of the second hole 31, 34. If desired, borehole section 27 may be widened to form the dotted chamber 36. When the combustion has got going, the gasification medium can be supplied in the direction of the arrows along borehole 23, 24, 27, while after the coal has been ignited, for example, in chamber 30 and is producing combustile gas according to the 'reversed flow gasification' method, the combustible gases can be taken off in the direction of the arrows along boreholes 31, 33.

What is claimed is:

1. A method for recovering coal in situ by drilling two bore holes from the surface into the coal seam, at least one of which holes is at least partially located in the plane of the coal seam, linking the two bore holes near their ends, supplying a medium that will react with the coal by way of one of the bore holes and withdrawing the reaction product along the other bore hole, the improvement comprising drilling the bore hole that is at least partially located in the plane of the coal seam prior to drilling the other bore hole, enlarging the first drilled bore hole at least at its end over such a length and to such a width as corresponds with at least twice the maximum deviation to be expected in the horizontal projection of the second drilled bore hole, drilling the second bore hole at least so far as to connect with the enlarged end of the first bore hole.

2. Method according to claim 1, characterized in that the widening (30) is made with mechanical means.

3. Method according to claims 1 or 2, characterized in that the second borehole (31) is driven so far as to connect with the widened section (30) of the first bore-hole, and in such a position as to intersect the strata of the subsidiary rock.

4. Method according to claims 1 or 2, characterized in that the second borehole (31) is at least partially driven in the plane of the coal seam.

5. The method as claimed in claim 4 characterized in that one bore hole is widened over a large part of its travel in the coal.

* * * * *